US009193161B2

(12) United States Patent
Naeli

(10) Patent No.: US 9,193,161 B2
(45) Date of Patent: Nov. 24, 2015

(54) FLUID CIRCULATION WITHIN CHAMBER

(75) Inventor: Kianoush Naeli, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/373,863

(22) PCT Filed: Apr. 19, 2012

(86) PCT No.: PCT/US2012/034190
§ 371 (c)(1),
(2), (4) Date: Oct. 6, 2014

(87) PCT Pub. No.: WO2013/158100
PCT Pub. Date: Oct. 24, 2013

(65) Prior Publication Data

US 2015/0062256 A1 Mar. 5, 2015

(51) Int. Cl.
*B41J 2/05* (2006.01)
*B41J 2/14* (2006.01)
*B41J 2/175* (2006.01)

(52) U.S. Cl.
CPC ..... *B41J 2/14201* (2013.01); *B41J 2/14233* (2013.01); *B41J 2/175* (2013.01); *B41J 2202/12* (2013.01)

(58) Field of Classification Search
None
See application file for complete search history.

(56) References Cited

U.S. PATENT DOCUMENTS

| | | | | |
|---|---|---|---|---|
| 6,910,797 | B2 * | 6/2005 | Falcon | 366/127 |
| 7,597,428 | B2 | 10/2009 | Tanuma | |
| 7,770,990 | B2 | 8/2010 | Nagashima | |
| 2008/0036823 | A1 * | 2/2008 | Tanuma | 347/70 |
| 2009/0033718 | A1 * | 2/2009 | Faase et al. | 347/54 |
| 2010/0238232 | A1 | 9/2010 | Clarke et al. | |
| 2011/0102516 | A1 | 5/2011 | Mardilovich et al. | |
| 2011/0115852 | A1 | 5/2011 | Bibl et al. | |
| 2011/0242237 | A1 | 10/2011 | Uezawa | |

FOREIGN PATENT DOCUMENTS

| | | | |
|---|---|---|---|
| JP | 07-251504 | A | 10/1995 |
| JP | 2010221443 | A | 10/2010 |
| JP | 2011-245795 | A | 12/2011 |
| KR | 10-1999-0069797 | A | 9/1999 |

OTHER PUBLICATIONS

International Search Report and Written Opinion for International Application No. PCT/US2012/034190 dated Dec. 12, 2012, 8 pp.

* cited by examiner

*Primary Examiner* — Erica Lin
(74) *Attorney, Agent, or Firm* — Hewlett-Packard Patent Department

(57) ABSTRACT

A printhead or other fluid handling device includes a firing chamber. Plural actuators are configured to cause fluid to be drawn into or ejected from the firing chamber. The actuators can also cause fluid to circulate within the firing chamber without appreciable fluid flow out of or into the firing chamber. Electronic signals independently control the respective actuators in accordance with various operating modes. Problems associated with fluid drying, separation of constituents within the fluid and other phenomenon are reduced or eliminated accordingly.

20 Claims, 4 Drawing Sheets

200

| | ACUTATOR #1 | ACUTATOR #2 | PHASE DIFF. | RESULT |
|---|---|---|---|---|
| 202 | IDLE | IDLE | 0 DEG | NO FLOW |
| 204 | COMPRESS | COMPRESS | 0 DEG | FIRING |
| 206 | EXPAND | EXPAND | 0 DEG | REFILL |
| 208 | COMPRESS -> EXPAND | EXPAND -> COMPRESS | 180 DEG | CIRCULATE |
| 210 | IDLE -> COMP. LAGGING | IDLE -> COMP. LEADING | 90 DEG | FIRING |
| 212 | IDLE -> EXPAND LEADING | IDLE -> EXPAND LAGGING | 90 DEG | REFILL |

FLUID CIRCULATION WITHIN CHAMBER

BACKGROUND

Ink-jet printers form images on media by controlled ejection of ink from a printhead. Ink is present within a particular firing chamber of the printhead prior to being ejected through a corresponding nozzle. However, dogging of an inkjet nozzle can occur if ink is allowed to dwell within a firing chamber for sufficient time to dry out. Additionally, dwell time can cause constituents in the ink to stratify or precipitate out of solution. Such dogging, stratification or precipitation can result in malformed images, improper color rendition, streaks or other artifacts on the printed media, and so on. The present teachings address the foregoing and related concerns.

BRIEF DESCRIPTION OF THE DRAWINGS

The present embodiments will now be described, by way of example, with reference to the accompanying drawings, in which.

DETAILED DESCRIPTION

Introduction

Apparatus and methods related to inkjet printing or other fluid handling are provided. A printhead or other device includes a firing chamber. Plural actuators are configured to cause a fluid to be drawn into the firing chamber by way of an inlet port, and to cause an ejection or "firing" of the fluid through a nozzle. The actuators are also configured to cause a circulation of the fluid within the firing chamber, without any appreciable flow of the fluid into or out of the firing chamber. Electronic signals independently control the respective actuators in accordance with various operating modes. Various problems associated with fluid drying, dwell time, or other aspects are reduced or eliminated.

In one example, an apparatus includes a material defining a firing chamber of a fluid dispensing device. The apparatus also includes a diaphragm defining one wall of the firing chamber. The apparatus additionally includes plural actuators that are configured to manipulate the diaphragm so as to circulate a fluid within the firing chamber in accordance with control signaling. The circulating is performed without fluid flow into or out of the firing chamber.

In another example, a method includes the step of controlling two or more actuators of a printhead. The method also includes circulating ink within a firing chamber of the printhead by way of the controlling.

First Illustrative System

Figure 1A:
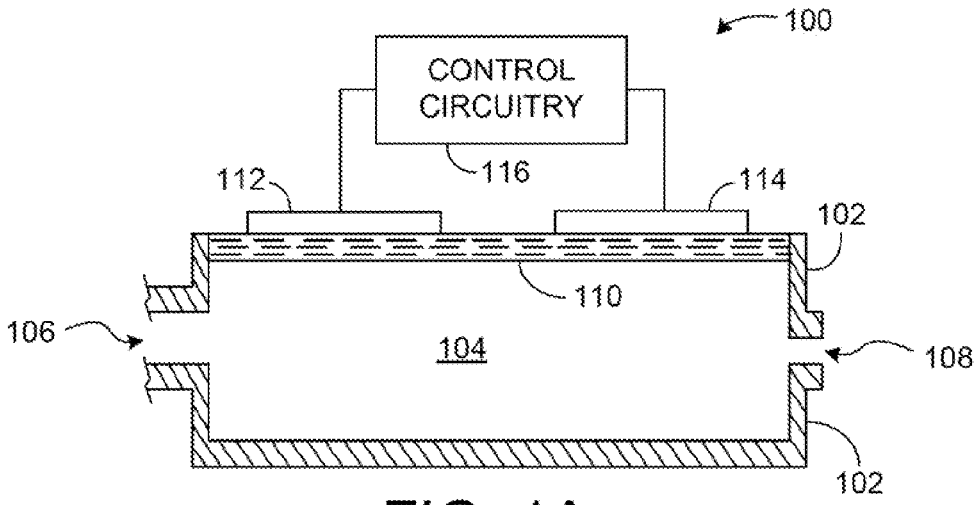
FIG. 1A depicts section view of a system in an idle operation according to one example of the present teachings.

Attention is now turned to FIG. 1A, which depicts a system 100 according to the present teachings. The system 100 is illustrative and non-limiting with respect to the present teachings. Other systems, devices, printheads and apparatus having other respective characteristics can also be defined and used. In at least one example, the system 100 is also referred to as an inkjet printing system 100 or a portion thereof. In one example, such an inkjet printing system 100 includes or is defined by a side-shooter printhead.

The system 100 includes a solid material 102 (depicted in sectional view) formed to define a firing chamber (chamber) 104. In one example, the solid material 102 is silicon formed by way of photolithography or another suitable process. Other suitable materials or formative processes can also be used. In one example, the chamber 104 is defined by an internal volume or cavity of 75 picoliters (i.e., 1 picoliter=$10^{-12}$ liters). Other suitable volumes can also be used.

The solid material 102 is also formed to define an inlet port 106 and a nozzle 108 both of which are in fluid communication with the chamber 104. In one example, the inlet port 106 is defined by a cross-sectional area (or throat) of $7500\times10^{-12}$ meters squared, and the nozzle 108 is defined by a throat of $800\times10^{-12}$ meters squared. Other suitable dimensions can also be used.

The system 100 also includes a diaphragm 110 defining a wall of the chamber 104. Thus, the chamber 104 is substantially enclosed but for the inlet port 106 and the nozzle 108. The diaphragm 110 is formed from material having suitable elastic or plastic characteristics such as glass. Other suitable materials can also be used. Flexing of the diaphragm 110 alters (i.e., reduces or increases) the internal volume of the chamber 104. The diaphragm 110 is depicted in an "idle" or "resting" state in FIG. 1A.

The system 100 also an actuator 112 and an actuator 114. The respective actuators 112 and 114 are in contact with and configured to flex the diaphragm 110 toward (i.e., compress) and away from (i.e., expand) the chamber 104. The actuators 112 and 114 are thus configured to reduce or increase the internal volume of the chamber 104 by way of corresponding manipulations of the diaphragm 110. In one example, the actuators 112 and 114 are respectively defined by piezoelectric actuators (or transducers). Other suitable actuators can also be used. The actuators 112 and 114 operate in accordance with electrical signals provided thereto.

The system 100 also includes control circuitry 116. The control circuitry is configured to provide respective electrical control signals to the actuator 112 and the actuator 114. Thus, the control circuitry 116 can independently control the actuators 112 and 114. The control circuitry 116 can be defined by or include any suitable constituency including, for non-limiting example, a microprocessor or microcontroller, a state machine, analog or digital or hybrid circuitry, a application specific integrated circuit (ASIC), and so on.

In particular, the control circuitry 116 can cause the actuators 112 and 114 to manipulate or drive the diaphragm 110 so as to cause fluid (e.g., printing ink, another liquid, and so on) to be drawn into the chamber 104 through the inlet port 106, to eject fluid out of the chamber 104 through the nozzle 108, and to circulate fluid within the chamber 104 without appreciable flow through either the inlet port 106 or the nozzle 108.

The illustrative system 100 includes two actuators 112 and 114, respectively, in the interest of clarity. However, the present teachings contemplate other examples having any suitable number of actuators configured to act upon a firing chamber of a printhead or other construct.

Illustrative Fluid Ejection Operation

Figure 1B:
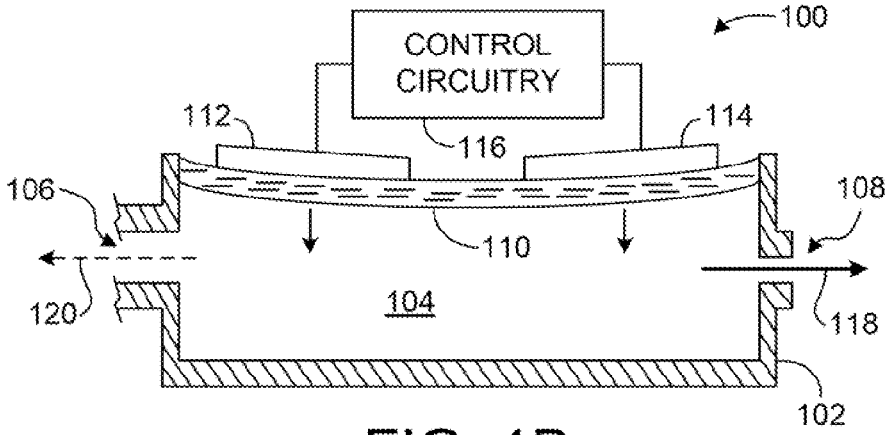
FIG. 1B depicts the system of FIG. 1A in a fluid ejection operation.

Reference is now made to FIG. 1B, which depicts the system 100 in a fluid ejection state of operation. The control circuitry 116 provides control signaling to the respective actuators 112 and 114 causing them to flex the diaphragm 110 toward the interior of the chamber 104. The internal volume of the chamber 104 is thus reduced, relative to it resting (or idle) volume as depicted in FIG. 1A.

Fluid such as, for non-limiting example, printing ink, is forcibly ejected out of the chamber 104 by way of the inward flexure of the diaphragm 110. A relatively greater quantity of fluid is ejected out of the nozzle 108 as indicated by arrow 118. A relatively lesser (or insignificant) quantity of fluid is ejected out of the inlet port 106 as indicated by the dashed arrow 120. This is due to the fact that, under normal illustrative operations, a flow of fluid out of the nozzle 108 is resisted only by a meniscus and ambient air, while a flow of fluid out of the inlet port 106 is resisted by a mass like fluid within a supply conduit. The quantity of fluid ejected through the nozzle 108 can be controlled in accordance with normal ink-jet printing operations. Other suitable applications can also be used.

Illustrative Fluid Refill Operation

Figure 1C:
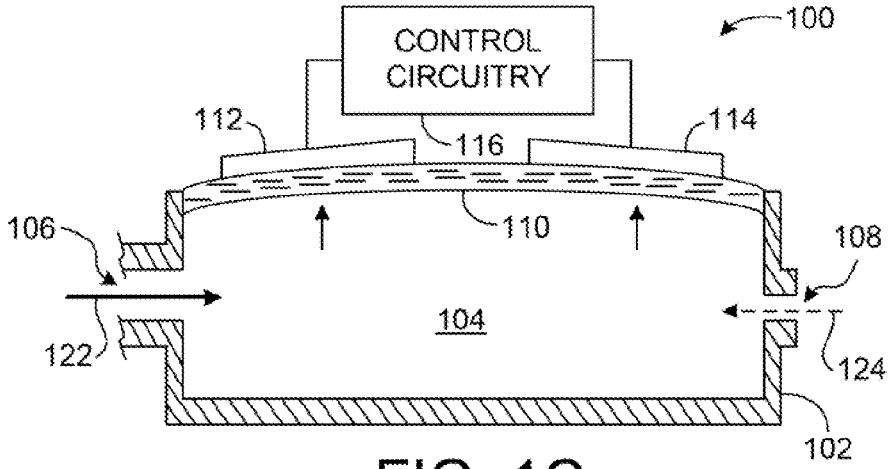
FIG. 1C depicts the system of FIG. 1A in a fluid refill operation.

Reference is now made to FIG. 1C, which depicts the system 100 in a fluid refill state of operation. The control circuitry 116 provides control signaling to the respective actuators 112 and 114 causing them to flex the diaphragm 110 away from the interior of the chamber 104. The internal volume of the chamber 104 is thus increased, relative to it resting volume as depicted in FIG. 1A.

Fluid, such as printing ink, is forcibly drawn into the chamber 104 by way of the outward flexure of the diaphragm 110. A relatively greater quantity of fluid (e.g., ink) is drawn through the inlet port 106 as indicated by arrow 118. A relatively lesser (or insignificant) quantity of fluid, or the meniscus alone, is drawn inward through the nozzle 108 as indicated by the dashed arrow 124. This behavior is attributable to the mass of fluid present at the inlet port 106 and the greater cross-sectional (throat) area of the inlet port 106 relative to that of the nozzle 108. The quantity of fluid drawn through the inlet port 106 can be controlled in accordance with normal ink-jet printing operations. Other suitable applications can also be used.

Illustrative Fluid Circulation Operation

Figures 1D, 2:
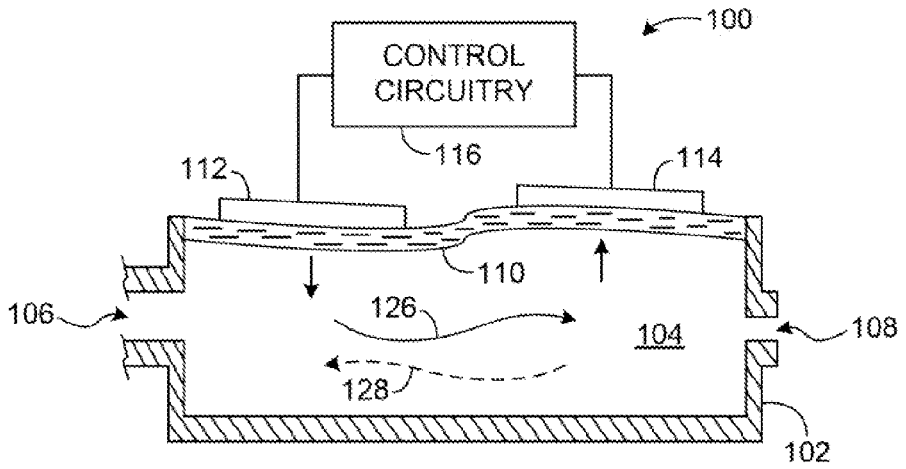
FIG. 1D depicts the system of FIG. 1A in a fluid circulation operation.
FIG. 2 depicts a table of operating modes according to another example.

Attention is turned now to FIG. 1D, which depicts the system 100 in a fluid circulation state of operation. The control circuitry 116 provides control signaling to the actuators 112 and 114 causing them to operate independently and with a phase difference of one-hundred eighty degrees between them. That is, the actuators 112 and 114 are individually controlled so as to flex the diaphragm 110 in opposite directions, out of phase, toward and away from the interior of the chamber 104.

As depicted, the actuator 112 has flexed (or driven) an affected portion of the diaphragm 110 toward the interior of the chamber 104, while the actuator 114 has flexed another portion of the diaphragm 110 away from the interior of the chamber 104. In response, a portion of the chamber 104 is reduced in volume and another portion is increased in volume. This causes fluid (e.g., ink) within the chamber 104 to flow toward the greater volumetric portion as indicated by the arrow 126. This represents one-half cycle of operation of the actuators 112 and 114 during fluid circulation.

Conversely, the actuators 112 and 114 are signaled to flex the diaphragm 110 in respectively opposite directions during a following half-cycle of operation. Fluid within the chamber 104 responds by flowing toward the other volumetric portion as indicated by the dashed arrow 128. It is noted that the overall internal volume of the chamber 104 as depicted in FIG. 1D is not appreciably changed relative to the resting volume depicted in FIG. 1A during fluid circulation operation.

The full-cycle effect is that fluid is circulated back and forth within the chamber 104 and without flow (or without appreciable flow) through either the inlet port 106 or the nozzle 108. Such circulation of fluid functions to prevent drying, stratification, precipitation, or other phenomenon that can lead to clogging of the nozzle 108 or other undesirable results. It is also noted that such circulation of fluid within the chamber 104 does not require, or can be performed independent of, circulation of that fluid within other portions of an associated printhead, printer, fluid dispensing device, or other apparatus.

Illustrative Table of Operating Modes

Reference is made now to FIG. 2, which depicts a table 200 of respective operating modes in accordance with the present teachings. The table 200 is directed to a system having two actuators affective with respect to a single firing chamber. Thus, the table 200 corresponds to illustrative operating modes for system 100. However, the present teachings contemplate other systems having other numbers of actuators and operating in accordance with respectively varying modes and characteristics. Thus, the table 200 is illustrative and non-limiting with respect to the present teachings.

Row 202 of the table 200 depicts actuator functions and results for a first mode of operation. Specifically, a first actuator "#1" (e.g., 112) and a second actuator "#2" (e.g., 114) are idle or at rest, such that a phase difference of zero degrees is defined between them. The result is no flow of fluid into, out of, or within a corresponding firing chamber (e.g., 104). The row 202 corresponds to the idle mode depicted in FIG. 1A.

Row 204 depicts a second mode of operation. The first actuator and the second actuator are both exerting compressive or inward-directed forces upon a diaphragm (e.g., 110). This mode is pulse-like in character and can be a portion of another operation. A phase difference of zero degrees is defined between their respective actions. The result is a flow of fluid out of the corresponding firing chamber, with the greater relative flow being through a nozzle (e.g., 108). The row 204 corresponds to the fluid ejection (or firing) mode depicted in FIG. 1B.

Row 206 depicts a third mode of operation. The first actuator and the second actuator are both exerting expansive or outward-directed forces upon a diaphragm. A phase difference of zero degrees is defined between their respective actions. This mode is pulse-like in character and can be a portion of another operation. The result is a flow of fluid into the corresponding firing chamber, with the greater relative flow being through an inlet port (e.g., 106). The row 206 corresponds to the fluid refill mode depicted in FIG. 1C.

Row 208 depicts a fourth mode of operation. The first actuator is exerting a repeated cycle of: compressive—to expansive—to compressive forces upon a portion of a diaphragm. The second actuator is exerting a repeated cycle of: expansive—to compressive—to expansive forces upon another portion of the diaphragm. A phase difference of one-hundred eighty degrees is therefore defined between the respective actuators. The result is a circulation of fluid within the firing chamber, with little or no flow through either the inlet port or the nozzle. The row 208 corresponds to the fluid circulation mode depicted in FIG. 1D.

Row 210 depicts a fifth mode of operation. The first actuator lags the second actuator while each exerts an idle—to compressive—to idle sequence of forces upon respective portions of the diaphragm. This mode is pulse-like in character and can be a portion of an overall cyclic operation. A phase difference of ninety degrees is therefore defined between their respective actions. The result is an ejection or firing of fluid from the firing chamber by way of the nozzle.

Row 212 depicts a sixth mode of operation. The first actuator leads the second actuator while each exerts an idle—to expansive—to idle sequence of forces upon respective portions of the diaphragm. This mode is pulse-like in character and can be a portion of an overall cyclic operation. A phase difference of ninety degrees is therefore defined between their respective actions. The result is a refilling of fluid into the firing chamber by way of the inlet port.

Second Illustrative System

Figure 3:
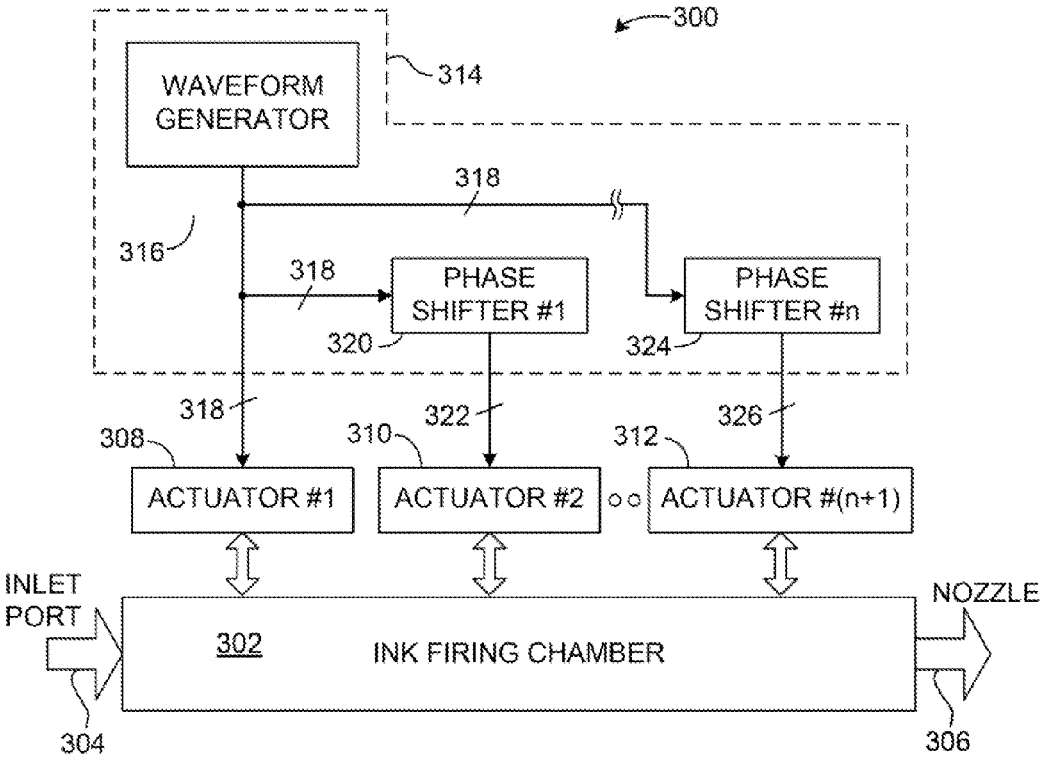
FIG. 3 depicts a schematic diagram of a system according to yet another example.

Reference is now directed to FIG. 3, which depicts a schematic diagram of a system 300 in accordance with the present teachings. The system 300 is illustrative and non-limiting in nature. Other systems, devices and apparatus can also be defined and used in accordance with the present teachings.

The system 300 includes an ink firing chamber (chamber) 302. The chamber 302 is configured to receive liquid printing ink by way of an inlet port 304 and to eject ink out of a nozzle 306. The chamber 302 is defined by an idle or resting state internal volume.

The system 300 also includes a count of (n+1) actuators, represented by an actuator "#1" 308, an actuator "#2" 310 and an actuator "#(n+1)" 312. Thus, the system 300 includes three illustrative actuators 308, 310 and 312. However, it is to be understood that such a system can include any suitable plurality of actuators (i.e., 2, 3, 4, 5, and so on). Each of the illustrative actuators 308-312 is configured to communicate forces to the chamber 302 so as to eject ink from the nozzle 306, draw refill ink through the inlet port 304, circulate ink within the chamber 302, and so on, in accordance with various operating modes of the system 300.

The system 300 further includes control circuitry 314. The control circuitry 314 can be defined by or include any suitable electronic constituency or components. The control circuitry 314 includes (or is configured to function as) a waveform generator 316. The waveform generator 316 provides signaling such as, for example, sinusoidal waves, pulses, square-waves or other waveforms in accordance with the various operating modes of the system 300. As depicted, the waveform generator 316 provides an output signal 318 that is coupled directly to the actuator 308.

The control circuitry 314 also includes (or is configured to function as) a phase shifter "#1" 320. The phase-shifter 320 is configured to receive the output signal 318 and to shift the phase of that signal by a predetermined amount. The phase-shifter 320 then provides a phase-shifted output signal 322 to the second actuator 310.

In one example, the amount of the phase shift used during circulation of ink within the chamber 302 is determined according to the expression: PD=A*K*360/n; where: PD=phase shift in degrees; n=total number of actuators (an integer); A=a dimensionless correction factor for actuator spacing, forces and other characteristics; and K=integer factor lesser than n. In one example, n=three, A=one, and K=one, such that PD=one-hundred twenty degrees of phase shift. Other phase shift examples or operating modes can also be used.

The control circuitry 314 also includes (or is configured to function as) a phase shifter "n" 324. The phase-shifter 324 is configured to receive the output signal 318 and to shift the phase of that signal by a predetermined amount. The phase-shifter 324 then provides a phase-shifted output signal 326 to the actuator 312. In one example, the amount of the phase shift is determined according to the expression described above. Other examples can also be used.

Illustrative Method

Figure 4:
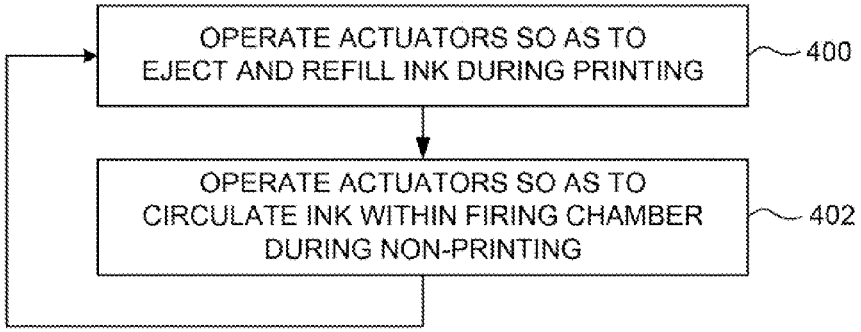
FIG. 4 depicts a flow diagram of a method according to the present teachings.

Reference is made now to FIG. 4, which is a flow diagram of a method according to the present teachings. The flow diagram of FIG. 4 depicts particular method steps and order of execution. However, the present teachings contemplate other methods including other steps, omitting one or more of the depicted steps, or proceeding in other orders of execution. Thus, the method of FIG. 4 is non-limiting with respect to the present teachings.

At 400, actuators are operated so as to eject ink during printing. For purposes of a present illustration, actuators 112 and 114 are controlled by way of control signaling provided by control circuitry 116. The actuators are operated such that printing ink is ejected from the chamber 104 through the nozzle 108 so as to print image on a media (e.g., paper). The actuators 112 and 114 are also operated so as to refill the chamber 104 with printing ink by way of the inlet port 106. Thus, normal typical inkjet printing operations are performed.

At 402, the actuators are operated so as to circulate ink within a firing chamber during non-printing. For purposes of the present illustration, the actuators 112 and 114 are operated with a one-hundred eighty degree phase difference between them, such that ink is circulated within the chamber 104 and without appreciable flow through the inlet port 106 or the nozzle 108. This circulation mode can be performed continuously, intermittently or periodically until the method returns to step 400 above and normal printing operations are resumed.

Illustrative Printing Apparatus

Figure 5:
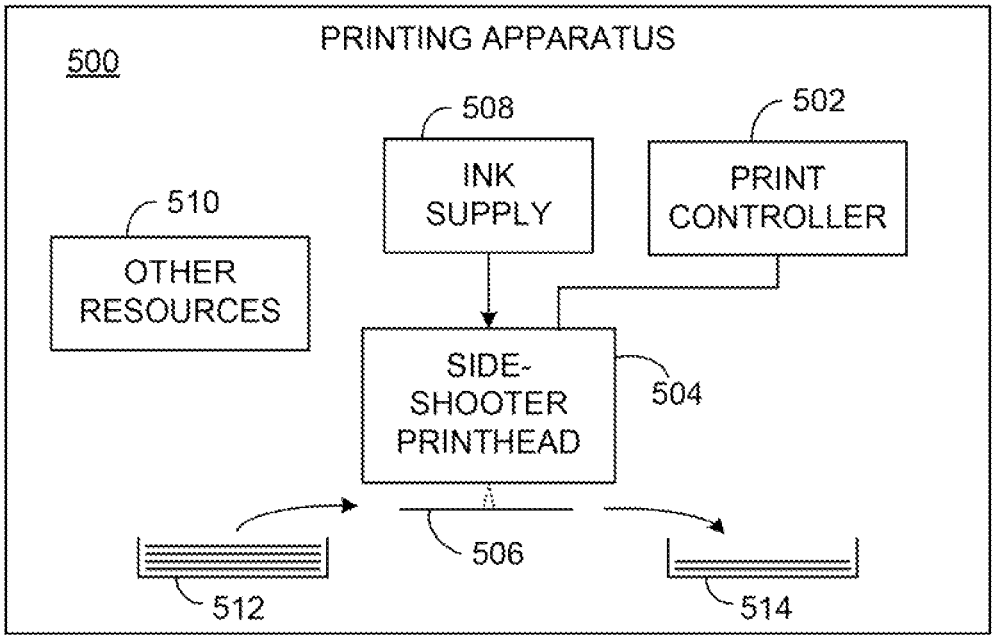
FIG. 5 depicts a block diagram of a printing apparatus according to another example.

Attention is turned now to FIG. 5, which depicts a block diagram of a printing apparatus (printer) 500. The printer 500 is illustrative and non-limiting with respect to the present teachings. Other printers or devices of respectively different configurations or resources can also be used.

The printer 500 includes a print controller 502 configured to control various normal operations of the printer 500. The print controller 502 can be defined by or include a processor configured to operate in accordance with a machine-readable program code, an ASIC, a state machine, and so on. Other constituency can also be used.

The printer 500 also includes a side-shooter printhead (printhead) 504. The printhead 504 is configured to form images on sheet media 506 in accordance with electronic signaling provided by the print controller 502. The printhead 504 includes one or more firing chambers (e.g., 104) having respective pluralities of actuators (e.g., 112, 114) configured to function in accordance with the present teachings. Thus, the printhead 504 can be operated such that an ink or inks can be ejected from the respective firing chambers, refill the chambers, be circulated within the chambers, and so on.

The printer 500 also includes an ink supply 508. The ink supply 508 is configured to provide one or more colors of printing ink to the printhead 504 by way of fluid coupling there between. In one example, the ink supply 508 is distinct from the printhead 504. In another example, the ink supply 508 is at least partially integrated with the printhead 504. Other suitable configurations can also be used.

The printer 500 further includes other resources 510. The other resources 510 can be defined by any suitable constituency including, without limitation, a power supply, a user interface, a display screen, network communications circuitry, wireless communications circuitry, computer-accessible data storage, media handling or transport mechanisms, and so on. Other constituents can also be used. One having ordinary skill in the printer or related arts can appreciate that various resources can be incorporated within varying embodiments of printers, and further elaboration is not required for purposes of the present teachings.

Typical, normal operation of the printer 500 is as follows: a data file corresponding to images to be printed onto media is received by the print controller 502 from an external entity (e.g., a computer). The print controller 502 provides electronic signaling to the printhead 504 so as to form the images onto sheet media 506. Successive sheets of media 506 are drawn from a supply 512, images (printing) formed thereon, and then accumulated within a receiver 514 such that a document of one or more printed sheets 506 is defined.

The ink supply 508 provides liquid ink (or inks) to the printhead 504 as needed during printing. At some time, a complete document has been printed and is awaiting user collection in the receiver 514. During this idle time between print jobs, the print controller 502 signals respective actuators (e.g., 112, 114) within the printhead 504 to circulate ink within the respective firing chambers (e.g., 104) thereof.

This ink circulation functions to prevent stratification, drying, and so on of the ink (or inks), further preventing dogged nozzles or other problems that can result. The printer 500 can then resume normal printing operations at some time thereafter. This print-circulate-print sequence can be repeated indefinitely, protecting the printer 500 against various dwell time-related.

The present teachings contemplate any number of examples in which a plurality of actuators affects operation of a firing chamber, such as those in an inkjet printhead. The actuators can be piezoelectric or another suitable type. Electronic signals individually control each actuator during fluid ejection (e.g., printing), fluid refill or fluid circulation modes of operation. Phase differences between the respective actuator signals correspond to the different operating modes.

A particular chamber (e.g., ink firing chamber) can be affected or manipulated by any suitable number of actuators in accordance with control signaling. Inkjet printers, fluid measuring instruments, pharmaceutical dispensing or packaging devices and other apparatus can be defined and operated according to the present teachings.

In general, the foregoing description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

What is claimed is:

1. An apparatus, comprising:

a material defining a firing chamber of a fluid dispensing device;

a diaphragm defining one wall of the firing chamber; and plural actuators configured to manipulate the diaphragm so as to circulate a fluid within the firing chamber in accordance with control signaling, the circulating performed without fluid flow into or out of the firing chamber.

2. The apparatus according to claim 1, the material also defining an inlet port in fluid communication with the firing chamber, the actuators configured to manipulate the diaphragm so as to draw a fluid into the firing chamber by way of the inlet port in accordance with control signaling.

3. The apparatus according to claim 1, the material also defining a nozzle in fluid communication with the firing chamber, the actuators configured to manipulate the diaphragm so as to eject a fluid out of the firing chamber by way of the nozzle in accordance with control signaling.

4. The apparatus according to claim 1 further comprising electronic circuitry to provide respective control signals to the actuators.

5. The apparatus according to claim 4, the electronic circuitry such that the actuators are controlled in accordance with a phase difference between adjacent actuations of the actuators so as to circulate a fluid within the firing chamber in accordance with control signaling, the circulating performed without fluid flow into or out of the firing chamber.

6. The apparatus according to claim 4, the electronic circuitry such that a phase difference is defined between those of the control signals that are adjacent during the circulating, the phase difference determined in accordance with:

$$PD=A*K*360/n;$$

where: PD=phase difference between those of the control signals, for actuating the actuators, that are adjacent in degrees;

n=total number of actuators of the firing chamber;

A=dimensionless correction factor; and

K=integer factor lesser than n [K=1, 2, . . . , n−1].

7. The apparatus according to claim 5, the phase difference being such that one actuator leads another of the actuators by about ninety degrees of phase.

8. The apparatus according to claim 1, the fluid dispensing device being defined by a printhead configured to be fluidly coupled to at least one source of printing ink.

9. The apparatus according to claim 1, the fluid dispensing device defined by a side-shooter printhead.

10. The apparatus according to claim 1, the fluid dispensing device defined by a printhead, the apparatus further comprising a controller configured to cause the printhead to print images on media by way of signaling to the actuators.

11. The apparatus according to claim 1, at least one of the actuators defined by a piezoelectric-type actuator.

12. A method, comprising:

controlling two or more actuators of a printhead; and circulating ink within a firing chamber of the printhead by way of the controlling, the controlling during the circulating ink done in accordance with a phase difference between adjacent actuations of actuators as determined by:

$$PD=A*K*360/n;$$

where:

PD=phase difference between adjacent actuations of the actuators in degrees;

n=total number of actuators of the firing chamber;

A=dimensionless correction factor; and

K=integer factor lesser than n [K=1, 2, . . . , n−1].

13. The method according to claim 12, the circulating performed without ink flow into or out of the firing chamber.

14. The method according to claim 12 further comprising controlling the actuators to at least eject ink from the firing chamber through a nozzle of the printhead, or to draw ink into the firing chamber through inlet port of the printhead.

15. The apparatus according to claim 1, further comprising electronic circuitry, the electronic circuitry to actuate the actuators such that adjacent actuations of the actuators occurs with a phase difference based upon 360 degrees/n, wherein n is a number of actuators being successively actuated.

16. The method of claim 15, wherein the actuators comprise a first actuator and a second actuator and wherein the electronic circuitry is to actuate the first actuator and the second actuator with a phase difference of 180° between actuations the first actuator and actuation of the second actuator.

17. An apparatus comprising:

a fluid firing chamber;

a nozzle adjacent fluid firing chamber;

independently actuatable actuators along the fluid firing chamber; and electronic circuitry to independently actuate the actuators with a phase difference PD between adjacent actuations based upon 360 degrees/n, wherein n is a number of the independently actuatable actuators being successively actuated along the fluid firing chamber.

18. The apparatus of claim 17, wherein the independently actuatable actuators comprise a first actuator and a second actuator and wherein the phase difference between successive adjacent actuation of the first actuator and the second actuator is 180 degrees.

19. The apparatus of claim 17, wherein the phase difference is such that fluid is circulated within the firing chamber without fluid flow into or out of the firing chamber.

20. The apparatus of claim 17 further comprising a diaphragm forming one wall of the firing chamber and extending between the actuators and the firing chamber, wherein the actuators manipulate the diaphragm.

* * * * *